US007144310B2

(12) United States Patent
Longbrake

(10) Patent No.: US 7,144,310 B2
(45) Date of Patent: Dec. 5, 2006

(54) KNIFE SHARPENER APPARATUS

(76) Inventor: Howard R. Longbrake, 16740 Indian Hollow Rd., Grafton, OH (US) 44044

( * ) Notice: Subject to any disclaimer, the term of this patent is extended or adjusted under 35 U.S.C. 154(b) by 40 days.

(21) Appl. No.: 10/647,702

(22) Filed: Aug. 25, 2003

(65) Prior Publication Data

US 2005/0048885 A1 Mar. 3, 2005

(51) Int. Cl.
*B24B 23/06* (2006.01)
*B24B 3/54* (2006.01)
*B24B 3/60* (2006.01)

(52) U.S. Cl. ..... 451/349; 451/367; 451/371

(58) Field of Classification Search ..... 451/163, 451/164, 349, 367, 370, 371
See application file for complete search history.

(56) References Cited

U.S. PATENT DOCUMENTS

| | | | | | |
|---|---|---|---|---|---|
| 308,046 | A | * | 11/1884 | Williams | 76/82.2 |
| 961,010 | A | * | 6/1910 | Poitras et al. | 451/175 |
| 1,459,580 | A | * | 6/1923 | Downey et al. | 451/175 |
| 2,557,093 | A | * | 6/1951 | Garbarino | 76/82.2 |
| 3,417,356 | A | * | 12/1968 | Tschopp | 335/298 |
| 4,170,343 | A | | 10/1979 | Longbrake | |
| 4,216,627 | A | * | 8/1980 | Westrom | 451/175 |
| 4,320,892 | A | | 3/1982 | Longbrake | |
| 4,441,279 | A | | 4/1984 | Storm et al. | |
| 4,471,951 | A | | 9/1984 | LeVine | |
| 4,486,982 | A | | 12/1984 | Longbrake | |
| D278,237 | S | | 4/1985 | LeVine | |
| 4,512,112 | A | | 4/1985 | LeVine | |
| D287,815 | S | | 1/1987 | Johannsen | |
| 4,731,953 | A | | 3/1988 | Owen | |
| 4,777,770 | A | | 10/1988 | LeVine | |
| 4,791,873 | A | * | 12/1988 | Towfigh | 108/10 |
| 5,138,801 | A | | 8/1992 | Anthon et al. | |
| 5,185,958 | A | * | 2/1993 | Dale | 451/174 |
| D335,621 | S | | 5/1993 | Moody | |
| D363,202 | S | | 10/1995 | Ross | |
| 5,598,996 | A | * | 2/1997 | Rath | 248/163.1 |
| 6,168,509 | B1 | | 1/2001 | Presgrove | |

OTHER PUBLICATIONS

Two-page flyer entitled "Grampa Ray's Adjustasharp", from Grampa Ray's, 16740 Indian Hollow Road, Grafton, Ohio 44044, dated prior to Jan. 1991.
Four-page brochure entitled "Ray's Sharpening Jigs", from LO-RAY Sharpeners, 16740 Indian Hollow Road, Grafton, Ohio 44044, dated prior to Jan. 1991.
Advertisement, *Blade Trade Magazine*, published by American Blade, Inc., Chattanooga, TN 37421, p. 47, Winter 1989.

* cited by examiner

*Primary Examiner*—M. Rachuba
(74) *Attorney, Agent, or Firm*—Pearne & Gordon LLP

(57) ABSTRACT

An infinitely adjustable knife sharpener apparatus is provided. The apparatus comprises a clamping mechanism having a first clamp member and a second clamp member for securing a knife blade therebetween. At least one infinitely adjustable guide rod assembly is also included. For example, an infinitely adjustable guide rod can be employed to determine an angle to which a knife blade is sharpened. Additionally, or alternatively, an infinitely adjustable guide loop can be included to determine an angle to which the knife blade is sharpened. Further, the apparatus is adjustable via a plurality of apertures in at least one of the first and second clamp members. Repositioning the guide rod assembly along a length of the first and/or the second clamp members changes the sharpening angle of the apparatus. A swivel block can also be included to facilitate foldability of the guide rod assembly.

30 Claims, 6 Drawing Sheets

KNIFE SHARPENER APPARATUS

FIELD OF THE INVENTION

The present invention relates to a knife sharpener apparatus, and more particularly to a modular knife sharpener apparatus having an adjustable guide rod assembly.

DESCRIPTION OF THE RELATED ART

Several knife sharpener systems for hand tools are currently available. Such systems are generally sold as sharpening kits and typically include a hand held sharpening hone, and/or bench hone, and a clamping device for retaining knife blade to be sharpened. The clamping device includes a graduated guide, which has several openings for receiving the hand held sharpening hone. When the knife blade is clamped within the clamping device, the hand held sharpening hone is slid across a cutting edge of the blade at a prescribed angle depending on which opening of the guide arm receives the hand held sharpening hone. The knife sharpener systems can also be employed with a bench hone by moving an extension arm of the knife sharpener across a surface such that the knife blade slides across the bench hone. It is preferable that the sharpener assemblies be compact for use during a camping trip or for storage.

FIG. 1 illustrates a conventional knife sharpener apparatus 10. The apparatus 10 includes a first clamp member 15 and a second clamp member 20. The clamp members 15 and 20 are employed to secure a knife blade therebetween during a sharpening operation. A guide plate 25 having a plurality of openings 30 is secured to the first clamp member 15 via a fastener 35. The openings 30 are positioned at discrete locations along the guide plate 25 such that a sharpening hone (not shown) can be maintained along a cutting edge of the clamped knife blade at selected angles, which correspond to the discrete locations of the openings 30. The first and second clamp members 15 and 20 are coupled together via a thumbscrew 40 and maintained in position with respect to each other via another thumbscrew 45.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention relates to a modular knife sharpener apparatus that has infinitely adjustable sharpening angles. In accordance with a first aspect of the present invention, a knife sharpener apparatus is provided. The apparatus includes a clamping mechanism operable to secure a knife blade; and at least one infinitely adjustable guide rod coupled to the clamping mechanism to adjust a sharpening angle of the knife sharpener apparatus.

In accordance with another aspect of the present invention, a knife sharpener apparatus is provided. The apparatus includes a first clamp member and a second clamp member coupled to the first clamp member. The first and second clamp members are operable to secure a knife blade therebetween. The apparatus further includes a first guide rod coupled to the first clamp member; and a first infinitely adjustable guide loop coupled to the first guide rod to adjust a sharpening angle of the knife sharpener apparatus.

In accordance with yet another aspect of the present invention, a knife sharpener apparatus is provided. The apparatus includes a clamping mechanism; and a guide plate coupled to the clamping mechanism. The guide plate is vertically and/or horizontally adjustable with respect to the clamping mechanism.

In accordance with yet another aspect of the present invention, a knife sharpener apparatus is provided. The apparatus includes a clamping mechanism having a first clamp member and a second clamp member. At least one of the first and second clamp members includes a plurality of apertures. The apparatus further includes a guide rod that can secure to any one of the plurality of apertures to determine a sharpening angle of the apparatus.

In accordance with yet another aspect of the present invention, a knife sharpener apparatus is provided. The apparatus includes adjusting means for providing infinite sharpening angles for the apparatus; and means for facilitating compactability of the apparatus.

To the accomplishment of the foregoing and related ends, the invention then, comprises the features hereinafter fully described. The following description and the annexed drawings set forth in detail certain illustrative aspects of the invention. These aspects are indicative, however, of but a few of the various ways in which the principles of the invention may be employed and the present invention is intended to include all such aspects and their equivalents. Other object, advantages and novel features of the invention will become apparent from the following detailed description of the invention when considered in conjunction with the drawings.

DETAILED DESCRIPTION OF THE PREFERRED EMBODIMENTS OF THE INVENTION

Figure 1:
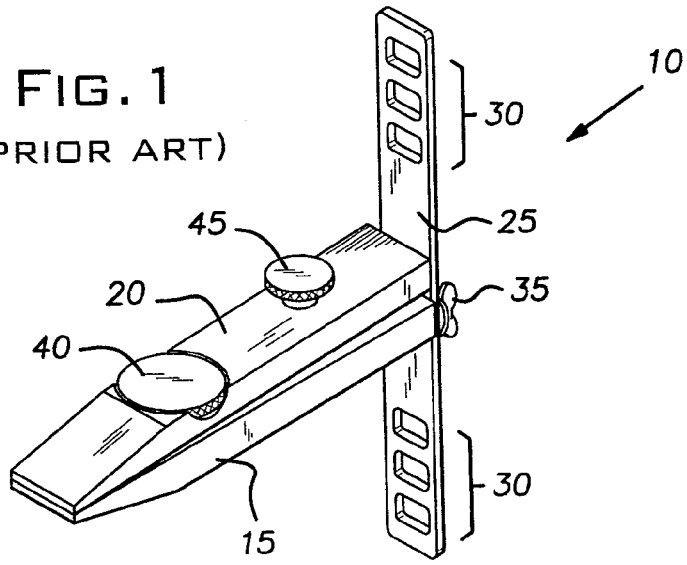
FIG. 1 (PRIOR ART)
FIG. 1 illustrates a prior art knife sharpener apparatus.

The present invention provides an easily adjustable and easily portable knife sharpener apparatus. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the-components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Figure 2:
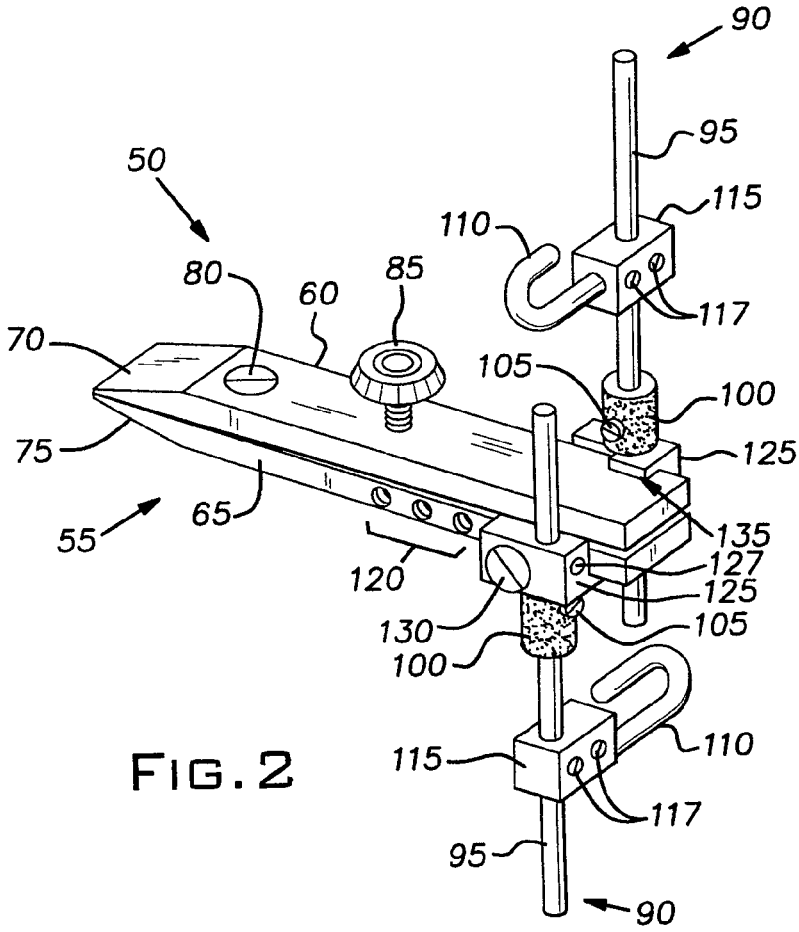
FIG. 2 illustrates a knife sharpener apparatus in accordance with an aspect of the present invention.

Referring initially to FIG. 2, a knife sharpener apparatus 50 in accordance with an aspect of the present invention is illustrated. The apparatus 50 comprises a clamping mechanism 55 having a first clamp member 60 and a second clamp member 65. The first and second clamp members 60 and 65 include first and second jaws 70 and 75, respectively, for securing a knife blade (not shown) therebetween. The first and second clamp members 60 and 65 are coupled together via a screw 80, or any other suitable fastener. The screw 80 extends through an aperture in the first clamp member 60 and is threadably received in a tapped bore located in the second clamp member 65. A thumbscrew 85, or any other suitable fastener, is threadably received in a tapped bore located in the first clamp member 60. An end of the thumbscrew 85 bears against a surface of the second clamp member 65 and is received in a dimple or complementary depression to mitigate sidewise movement of the first and second clamp members 60 and 65 relative to each other. A recess (not shown) can be provided within an inner portion of one or both of the jaws 70 and 75 to facilitate positioning of the knife blade within the jaws 70 and 75.

The knife sharpener apparatus 50 further includes at least one infinitely adjustable guide rod assembly 90. Two guide rod assemblies 90 are shown in FIG. 2, each extending from each of the clamp members 60 and 65. However, the knife sharpener apparatus 50 can include only one guide rod assembly extending from either clamp member or more than two guide rod assemblies extending from one or both clamp members and is contemplated as falling within the scope of the present invention. The adjustable guide rod assembly 90 comprises a guide rod 95 and a lock set. The lock set facilitates positioning the guide rod 95 at a desired height. For example, the lock set illustrated in FIG. 2 comprises a connector 100 which is secured to the guide rod 95 via a setscrew 105 along a desired length of the guide rod 95. Accordingly, if the guide rod 95 is removed from the apparatus 50, the connector 100 and setscrew 105 facilitates the guide rod 95 being re-positioned to the same height. It is to be appreciated that any means of positioning the guide rod 95 at a desired height can be employed. Moreover, any number of stops can be utilized to provide a reference to a given height. As another example, at least one sleeve (not shown) of a predetermined length can be placed over the guide rod 95 to position the guide rod 95 at a desired height.

The height of the guide rod 95 can determine an angle to which a knife blade is sharpened. When utilizing a bench hone (not shown), the guide rod 95 rides along a surface upon which the bench hone is located. Thus the height of the guide rod 95 controls the angle at which the knife blade contacts the bench hone. Because the guide rod 95 of the present invention has an infinitely adjustable height range, the knife sharpener apparatus 50 can be employed with a plurality of bench hones having different heights. Furthermore, the knife sharpener apparatus 50 can be employed with a single bench hone and achieve an infinite number of different angles. In contrast, conventional knife sharpener apparatuses are employed with bench hones of a single, predetermined height to achieve a single, predetermined angle.

Additionally, the guide rod assembly 90 can include an infinitely adjustable guide loop 110. The guide loop 110 is utilized to position and support a hand held sharpening hone (not shown) during a sharpening operation. A guide rod portion of the hand held sharpening hone rides along a bottom of the guide loop 110 to control an angle of the hand held sharpening hone. Thus, the location of the guide loop 110 along the guide rod 95 determines the angle to which the knife blade is sharpened. An adjustable guide block 115 can be utilized to position and secure the guide loop 110. For example, the adjustable guide block 115 includes at least two apertures, one for receiving the guide rod 95 and another for receiving an end portion of the guide loop 110. At least two tapped bores are also included in the guide block 115 for receiving setscrews 117. The setscrews 117 are utilized to secure the guide loop 110 in position with respect to the guide rod 95. Accordingly, the guide loop 110 can be located along the guide rod 95 at any desired height. In contrast, conventional knife sharpener apparatuses include a predetermined number of openings for receiving a hand held sharpening hone are disposed along extension arms at discrete intervals determined by a manufacturer.

In accordance with another aspect of the present invention, at least one of the first and second clamp members 60 and 65 comprises a plurality of threaded bores 120. The threaded bores 120 facilitate positioning and securing of one or more adjustable guide rod assemblies 90 at different locations along a length of the first and/or the second clamp members 60 and 65. The threaded bores 120 can be provided in a side of the first and/or second clamp members 60 at predetermined intervals. For example, repositioning the guide rod assembly(s) 90 from one threaded bore to an adjacent threaded bore can change the sharpening angle of the apparatus 50 by two-degrees. Thus, when utilizing the knife sharpener apparatus 50 in the field, the sharpening angle can be adjusted by moving the guide rod assembly(s) 90 forward along the clamp member(s) 60, 65 without any other adjustments. Such an adjustment will change the sharpening angle of the apparatus by substantially the same number of degrees when employing either the bench hone or the hand held hone.

Figure 3:
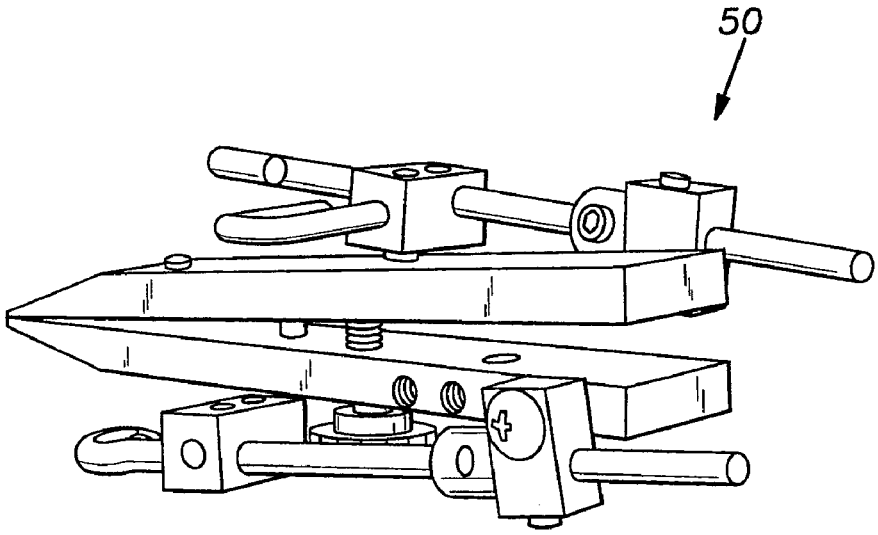
FIG. 3 illustrates the knife sharpener apparatus of FIG. 2 in a folded position in accordance with an aspect of the present invention.

A swivel block 125 can be utilized to couple the guide rod assembly(s) 90 to the clamp member(s) 60, 65. The swivel block 125 comprises a first aperture for receiving the guide rod assembly 90 and a corresponding threaded bore for securing the guide rod assembly 90 thereto via a setscrew 127. The swivel block 125 also comprises a second aperture for receiving a fastener 130, such as a screw, or the like, to couple the swivel block 125 and guide rod assembly 90 to one of the threaded bores 120. A lip portion 135 on the swivel block 125 facilitates positioning the guide rod assembly 90 at a ninety-degree angle with respect to the clamp member 60, 65 to which the guide rod assembly 90 is secured. Moreover, lip portion 135 facilitates a forward rotation of the guide rod assembly 90 when the fastener 130 is loosened. The guide rod assembly 90 can be rotated such that it is folded in towards the clamp members 60, 65, as depicted in FIG. 3. Accordingly, the knife sharpener apparatus 50 is more compact than conventional designs.

It is to be appreciated that a stationary block (not shown) can be employed in place of the swivel block 125. The stationary block can include a lip portion that extends the full length of the block to mitigate rotation of the guide rod assembly with respect to the clamp member. As another alternative, a fully rotatable block having no lip portion (not shown) can be employed to facilitate full rotation of the guide rod assembly with respect to the clamp member. Moreover, the block employed (swivel, stationary, or fully rotatable) can include a slot in place of the second aperture to provide for positioning of a guide rod assembly at locations between the threaded bores 120 provided on the clamp member 60, 65. Thus, the slot provides for an infinitely adjustable guide rod assembly along the length of the clamp member 60, 65.

Figure 4:
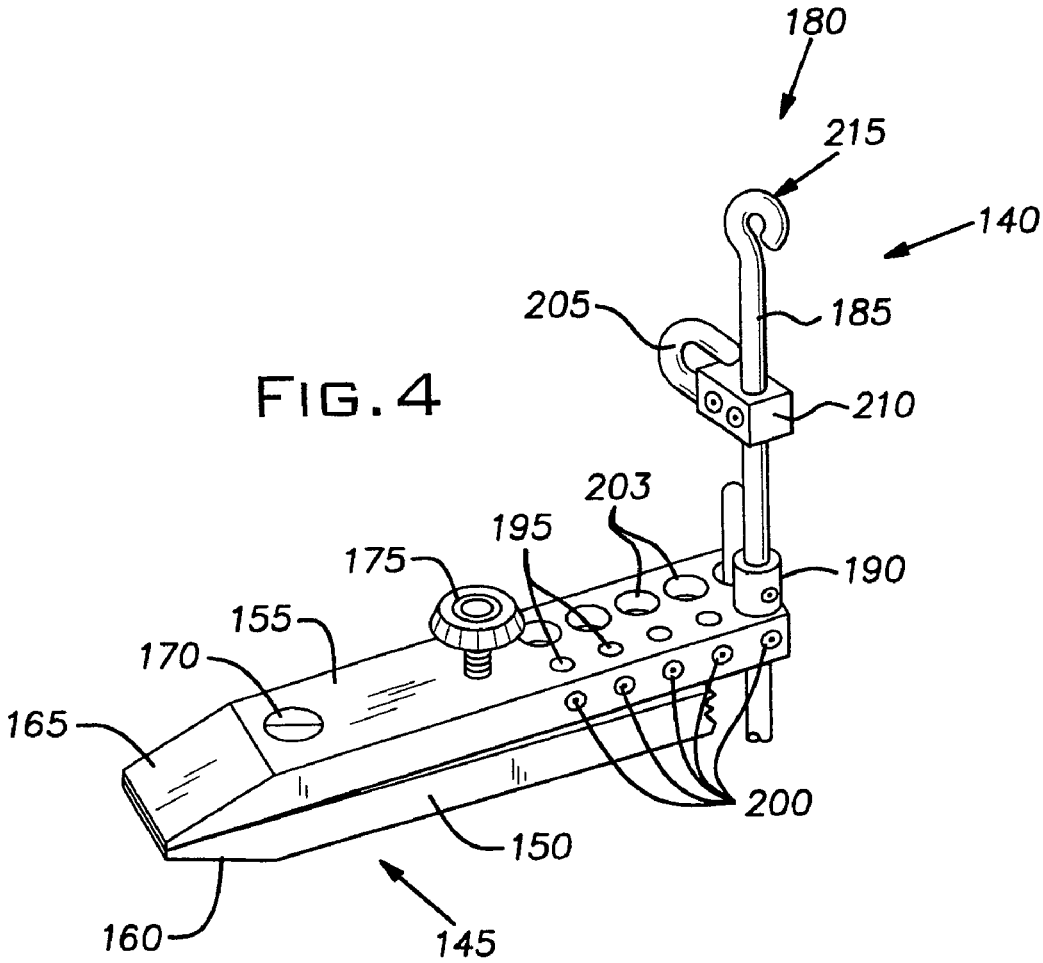
FIG. 4 illustrates another knife sharpener apparatus in accordance with an aspect of the present invention.

Turning now to FIG. 4, a knife sharpener apparatus 140 according to another aspect of the present invention is depicted. The knife sharpener apparatus 140 comprises a clamping mechanism 145. The clamping mechanism 145 includes first and second clamp members 150 and 155 having first and second jaws 160 and 165, respectively, for securing a knife blade (not shown) therebetween. The jaws 160 and 165 are coupled together via a fastener 170, such as a screw, or the like. A thumbscrew 175, or the like, is provided to mitigate sidewise movement of the first and second clamp members 150 and 155 relative to each other, in a manner similar to that described with respect to FIG. 2.

The knife sharpener apparatus 140 also includes an adjustable guide rod assembly 180. The adjustable guide rod assembly 180 comprises a guide rod 185 and a lock set 190. The lock set 190 facilitates setting the guide rod 185 at a desired height. For example, a connector can be secured via a setscrew along a desired length of the guide rod 185. The guide rod 185 is then inserted into one of a first set of apertures 195 located on a top portion of a clamp member 150, 155. The lock set 190 acts as a stop such that the guide rod 185 is positioned at the desired height. A plurality of tapped bores 200 are provided within a side portion of the clamp member 150,155. The plurality of tapped bores 200 correspond with the first set of apertures 195. Accordingly, a setscrew provided within one of the tapped bores 200 operates to secure the guide rod assembly 180 within the corresponding aperture 195. Having the first set of apertures 195 and corresponding tapped bores 200 located on the clamp member 150,155 facilitates adjustability with respect to the position of the guide rod assembly 180 along a length of the clamp member 150,155. A second set of second apertures 203 can also be provided within the clamp member 150, 155 to allow for an end portion of a guide rod 185 to pass through. Alternatively, a threaded guide rod (not shown) in combination with a stop mechanism and at least one tapped bore in the clamp member can be employed in place of the structure described above.

The adjustable guide rod assembly 180 further includes an infinitely adjustable guide loop 205 and guide block 210. The infinitely adjustable guide loop 205 provides for positioning and supporting a hand held sharpening hone at any desired angle rather than at predetermined, discrete angles provided by conventional apparatuses. The guide rod 185 also includes a rounded end portion 215 to facilitate movement of the knife sharpener apparatus 140 along a surface when utilizing the apparatus 140 with a bench hone.

Figure 5:
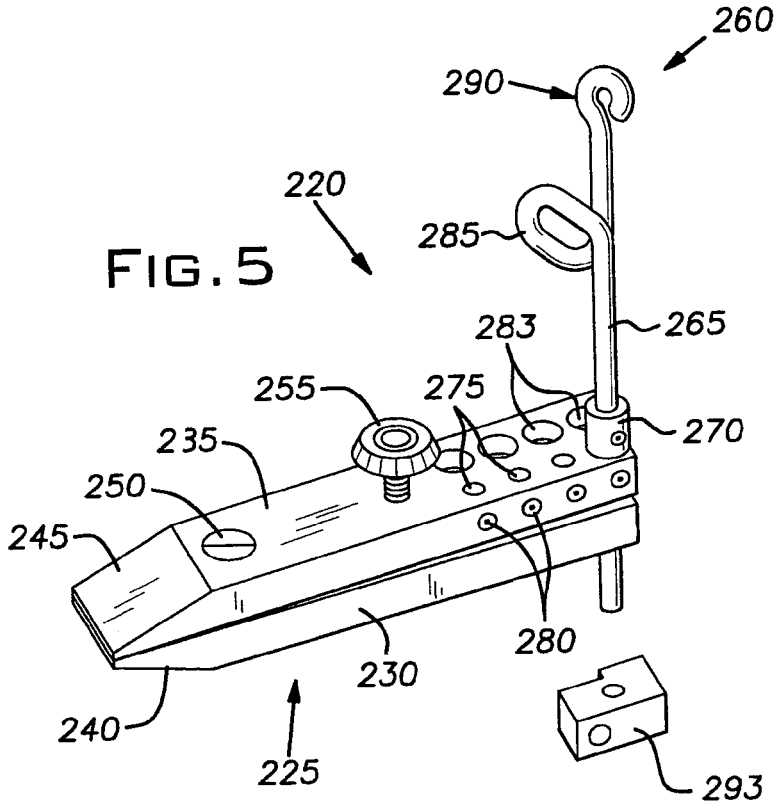
FIG. 5 illustrates yet another knife sharpener apparatus in accordance with an aspect of the present invention.

FIG. 5 illustrates yet another knife sharpener apparatus 220 in accordance with an aspect of the present invention. The knife sharpener apparatus 220 comprises a clamping mechanism 225, which includes first and second clamp members 230 and 235. The clamp members 230 and 235 include first and second jaws 240 and 245, respectively, for securing a knife blade (not shown) therebetween. The jaws 240 and 245 are coupled via a fastener 250, such as a screw, or the like. A thumbscrew 255, or the like, is provided to mitigate sidewise movement of the first and second clamp members 230 and 235 relative to each other, in a manner similar to that described with respect to FIG. 2.

The knife sharpener apparatus 220 also includes an adjustable guide rod assembly 260. The adjustable guide rod assembly 260 comprises a guide rod 265 and a lock set 270. The lock set 270 facilitates positioning and re-positioning the guide rod 265 at a desired height. Moreover, the lock set 270 is configured such that the height of the guide rod 265 is infinitely adjustable. A plurality of first apertures 275 and corresponding tapped bores 280 are provided within the clamp member 230, 235 to secure the guide rod assembly(s) 260 to the clamp member(s) 230, 235. A plurality of second apertures 283 can also be provided within the clamp member 230, 235 to allow for an end portion of a guide rod assembly(s) to pass through.

Figure 6:
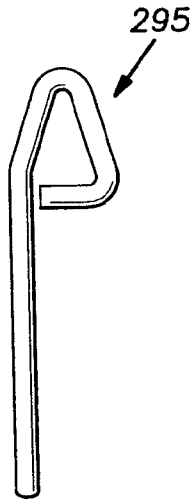
FIG. 6 illustrates a guide rod for a knife sharpener apparatus in accordance with an aspect of the present invention.

The guide rod 265 of the adjustable guide rod assembly 260 comprises an integral guide loop 285 to position and support a hand held sharpening hone (not shown) during a sharpening operation. The guide rod 265 also includes a rounded end portion 290 to facilitate movement of the knife sharpener apparatus 220 along a surface when utilizing the apparatus 220 with a bench hone. It is to be appreciated that any guide rod configuration of an integral guide loop can be employed, such as the triangular-shaped configuration 295 depicted in FIG. 6. The guide rods having integral guide loops can be configured such that with one setting, the knife sharpener apparatus can be employed with a bench hone and a hand held hone wherein there is a two-degree difference between utilizing the bench hone and the hand held hone. However, it is to be appreciated that the guide rods can be configured to any desired setting.

Figure 7:
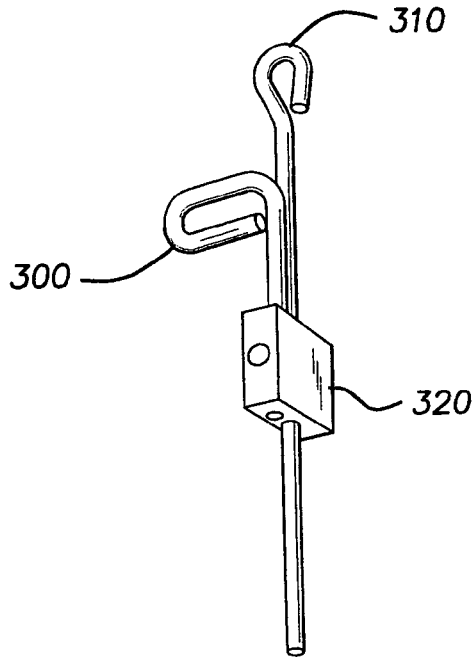
FIG. 7 illustrates a guide rod and guide loop assembly for a knife sharpener apparatus in accordance with an aspect of the present invention.

Moreover, turning now to FIG. 7, two guide rods can be employed in accordance with another aspect of the present invention. A first guide rod 300 can be utilized to provide for an infinitely adjustable guide loop and a second guide rod 310 can be utilized to provide for an infinitely adjustable guide rod height. The first and second guide rods 300 and 310 can be secured in position with a positioning mechanism, such as block 320.

Turning back to FIG. 5, it is to be appreciated that a swivel block 293 can be employed in place of the plurality of apertures 275 and corresponding tapped bores 280 to secure the guide rod assembly(s) 260 to the clamp member(s) 230, 235.

Figure 8:
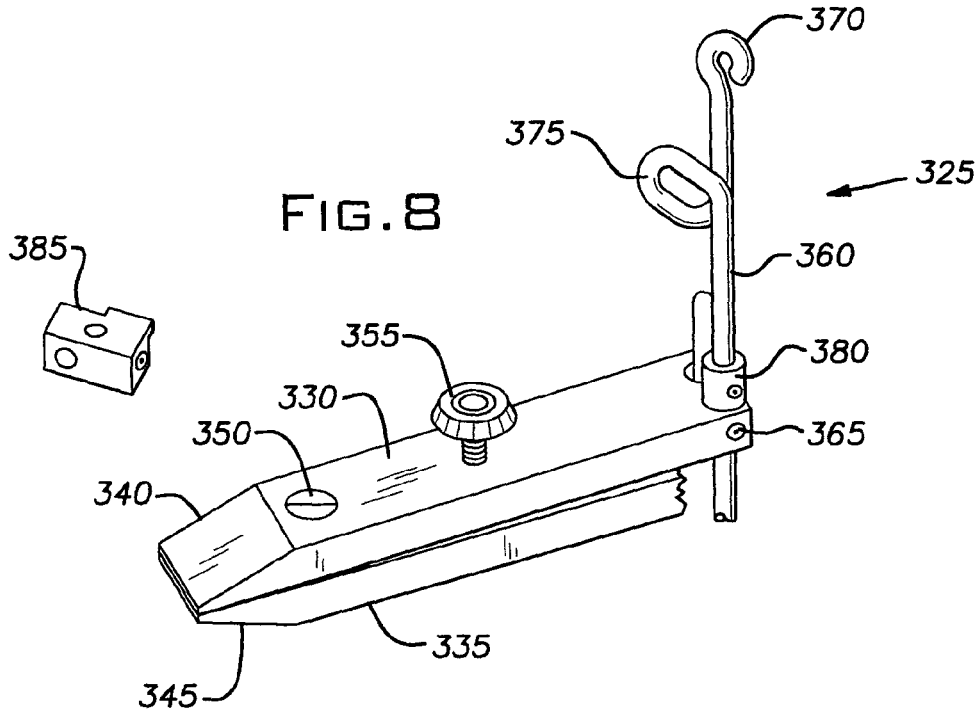
FIG. 8 illustrates yet another knife sharpener apparatus in accordance with an aspect of the present invention.

FIG. 8 illustrates yet another example of a knife sharpener apparatus 325 in accordance with an aspect of the present invention. The knife sharpener apparatus 325 includes a clamping mechanism having first and second clamp members 330, 335 and first and second jaws 340, 345. Similar to other clamping mechanisms described herein, a fastener 350 and thumbscrew 355 are provided to couple the first and second clamp members 330, 335. A guide rod 360 is inserted through an aperture in one of the clamp members 330, 335 and coupled to the clamp member 330, 335 via a setscrew 365. The guide rod 360 includes a rounded end portion 370 and a guide loop 375 integrally formed therein. The guide rod 360 is infinitely adjustable via a lock set 380. Accordingly, only one setting is needed to set the knife sharpener apparatus 325 to a desired angle. Moreover, the knife sharpener apparatus 325 can be employed with both bench hones and hand held hones without changing the setting. Although, it is to be appreciated that the setting can easily be changed via adjustment of the lock set 380. The guide rod 360 can be removed from the apparatus 325 for travel or storage by loosening the setscrew 365 and easily re-positioned to the same angle when ready for use due to the placement of the lock set 380.

Figure 9:
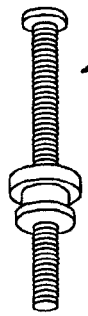
FIG. 9 illustrates another guide rod for a knife sharpener apparatus in accordance with an aspect of the present invention.

It is to be appreciated that any of the assemblies described herein can employ a threaded guide rod 383, as depicted in FIG. 9, in place of the smooth guide rods illustrated in FIGS. 2–8.

Figure 10:
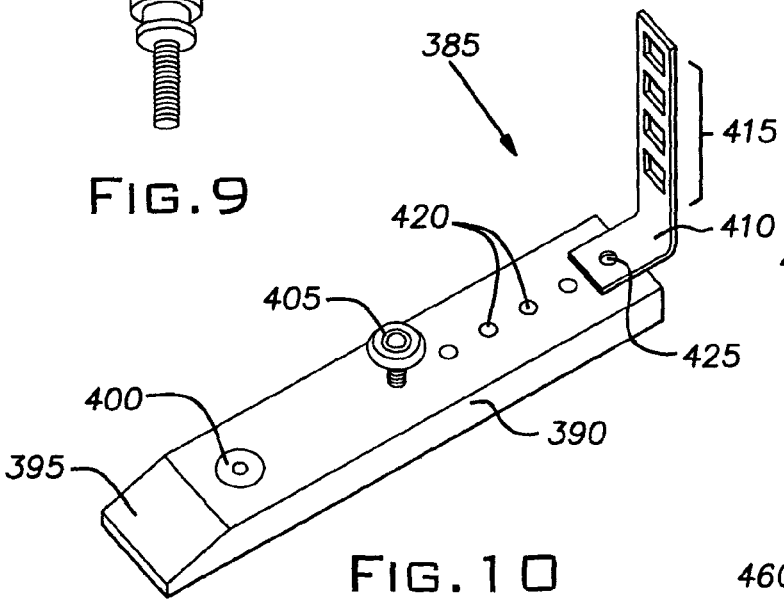
FIG. 10 illustrates yet another knife sharpener apparatus in accordance with an aspect of the present invention.

Yet another example of a knife sharpener apparatus 385 in accordance with an aspect of the present invention is shown in FIG. 10. Only one clamp member 390 and jaw 395 of a clamping mechanism is depicted for the sake of brevity. Similar to other clamping mechanisms described herein, a fastener 400 and thumbscrew 405 are provided to couple the first and second clamp members. An adjustable guide plate 410, having a plurality of openings 415 therein, can be coupled to the clamp member 390. The guide plate 410 has a fixed height and a discrete number of openings 415; however, the guide plate 410 is horizontally adjustable along a length of the clamp member 390 via a plurality of apertures 420 to change an angle of the openings 415. Moreover, the guide plate 410 can be made infinitely adjustable along the length of the clamp member 390 with the addition of an adjusting block (not shown). The adjusting block includes an aperture to couple the block to one of the apertures 420 in the clamp member 390 via a fastener. The adjusting block also includes a slot formed therein such that aperture 425 in the guide plate 390 aligns with the slot to slidably position the guide plate 390 at locations between the apertures 420 via a fastener.

It is to be appreciated that the angles provided by the guide plate 410 can also be adjusted by placing a spacer (not shown) between the guide plate 410 and the clamp member 390.

Figure 11:
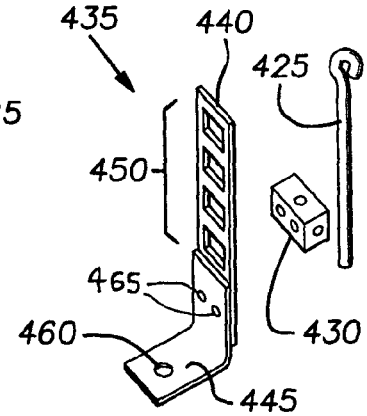
FIG. 11 illustrates a guide plate assembly in accordance with an aspect of the present invention.

Additionally, as illustrated in FIG. 11, a guide rod 425 and a guide plate block 430 can be employed with a guide plate assembly 435 to provide an infinitely adjustable sharpening angle when utilized with a bench hone. The guide rod 425 is inserted in an aperture located in the guide plate block 430 and secured in place with a setscrew. At least one other aperture is located in the guide plate block 430 to couple the guide plate block 430 with the guide plate assembly 435. Therefore, vertically repositioning the guide rod 425 within the guide plate block 430 and/or vertically repositioning the guide plate block 430 on the guide plate assembly 435 can infinitely adjust the guide rod 425, and thus, an angle of the knife sharpener apparatus.

Figure 12:
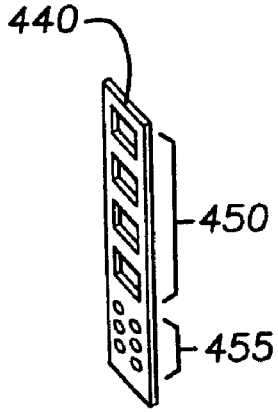
FIG. 12 illustrates a guide plate in accordance with an aspect of the present invention.

The guide plate assembly 435 comprises an adjustable guide plate 440 and a guide plate foot 445. The adjustable guide plate 440 includes a plurality of openings 450 for receiving a hand held sharpening hone. The locations of the openings 450 determine a sharpening angle of the knife sharpener apparatus. Accordingly, to sharpen a knife blade at an angle not provided by the openings 450, the guide plate 440 can be vertically adjusted via a plurality of apertures 455 (FIG. 12) located in the guide plate 440. The guide plate apertures 455 correspond with one or more apertures 465 located in the guide plate foot 445 to vertically reposition the guide plate 440 depending on the desired angle. The guide plate foot 445 also includes an aperture 460 to secure the guide plate assembly 435 to a clamping mechanism.

Figure 13:
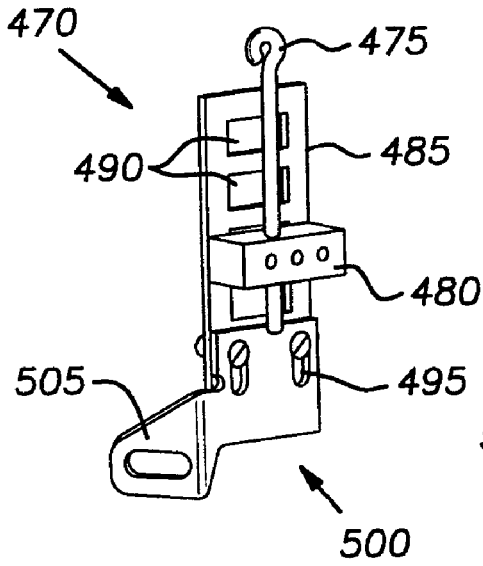
FIG. 13 illustrates another guide plate assembly in accordance with an aspect of the present invention.

FIG. 13 illustrates a guide plate assembly 470 for a knife sharpener apparatus in accordance with another aspect of the present invention. The guide plate assembly 470 includes a guide rod 475 and guide plate block 480 to provide an infinitely adjustable sharpening angle when utilized with a bench hone. The guide rod 475 and guide plate block 480 are assembled and employed in a manner similar to the guide rod 425 and guide plate block 430 of FIG. 11. Thus, further discussion of such components will be omitted for the sake of brevity. An adjustable guide plate 485 having a plurality of discrete openings 490 as well as one or more slots 495 located therein is also provided. The slots 495 facilitate vertical positioning of the guide plate 485 such that any desired angle can be attained when employed with a hand held sharpening hone. Slots 495 are utilized in a manner similar to apertures 455 discussed with respect to FIGS. 11 and 12.

Figure 14:
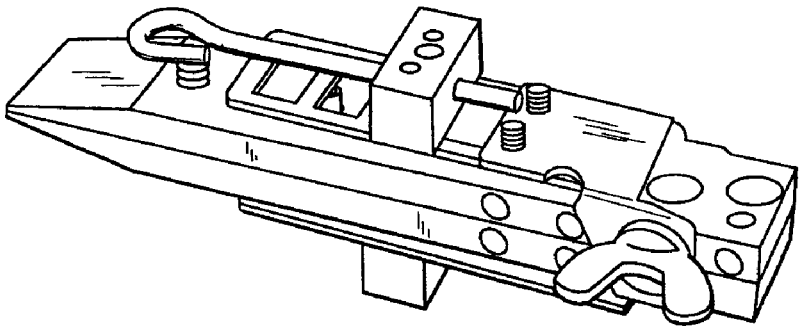
FIG. 14 illustrates a knife sharpener apparatus employing the guide plate assembly of FIG. 13 in a folded position in accordance with an aspect of the present invention.

The guide plate assembly 470 further includes a guide plate foot 500, which is utilized to couple the guide plate assembly 470 to a clamping mechanism. The guide plate foot 500 includes a flange portion 505 having an aperture therein for coupling the guide plate assembly 470 to an aperture provided in a side portion of a clamp member via a fastener. It is to be appreciated that the guide plate foot 500 can include a slot in place of the aperture to provide for forward and backward adjustment of the guide plate assembly 470. Such an adjustment operates to change the sharpening angle of the apparatus. When the fastener is loosened, the flange portion 505 allows the guide plate assembly 470 to rotate such that it folds in towards the clamp members 60, 65, as depicted in FIG. 14. Thus, guide plate assembly 470 is infinitely adjustable as well as foldable.

Figure 15:
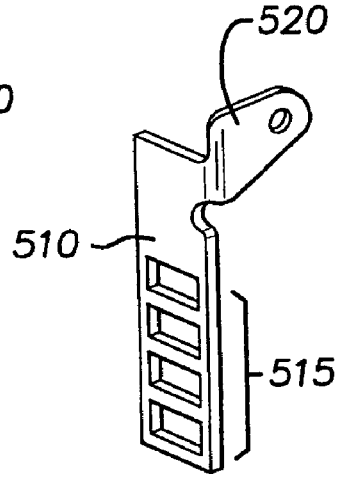
FIG. 15 illustrates yet another guide plate in accordance with an aspect of the present invention.

FIG. 15 depicts yet another guide plate 510 that can be employed with a knife sharpener apparatus in accordance with an aspect of the present invention. The guide plate 510 includes a plurality of openings 515 adapted to receive a hand held sharpening hone and a foldable foot portion 520 to facilitate foldability of the knife sharpener apparatus.

It is to be appreciated that the individual components of the knife sharpener apparatus described herein can be assembled or configured in any conceivable combination and is contemplated as falling within the scope of the present invention. Further, the components described herein can be of any suitable shape, size, and material and can be employed with hand held sharpening hones, bench hones, or both.

It is to be further appreciated that the apertures provided in the figures are for illustrative-purposes only and any number of apertures can be provided in the individual components. Moreover, any of the apertures illustrated can be replaced with slots to provide for increased adjustability of the knife sharpener apparatus.

Figure 16:
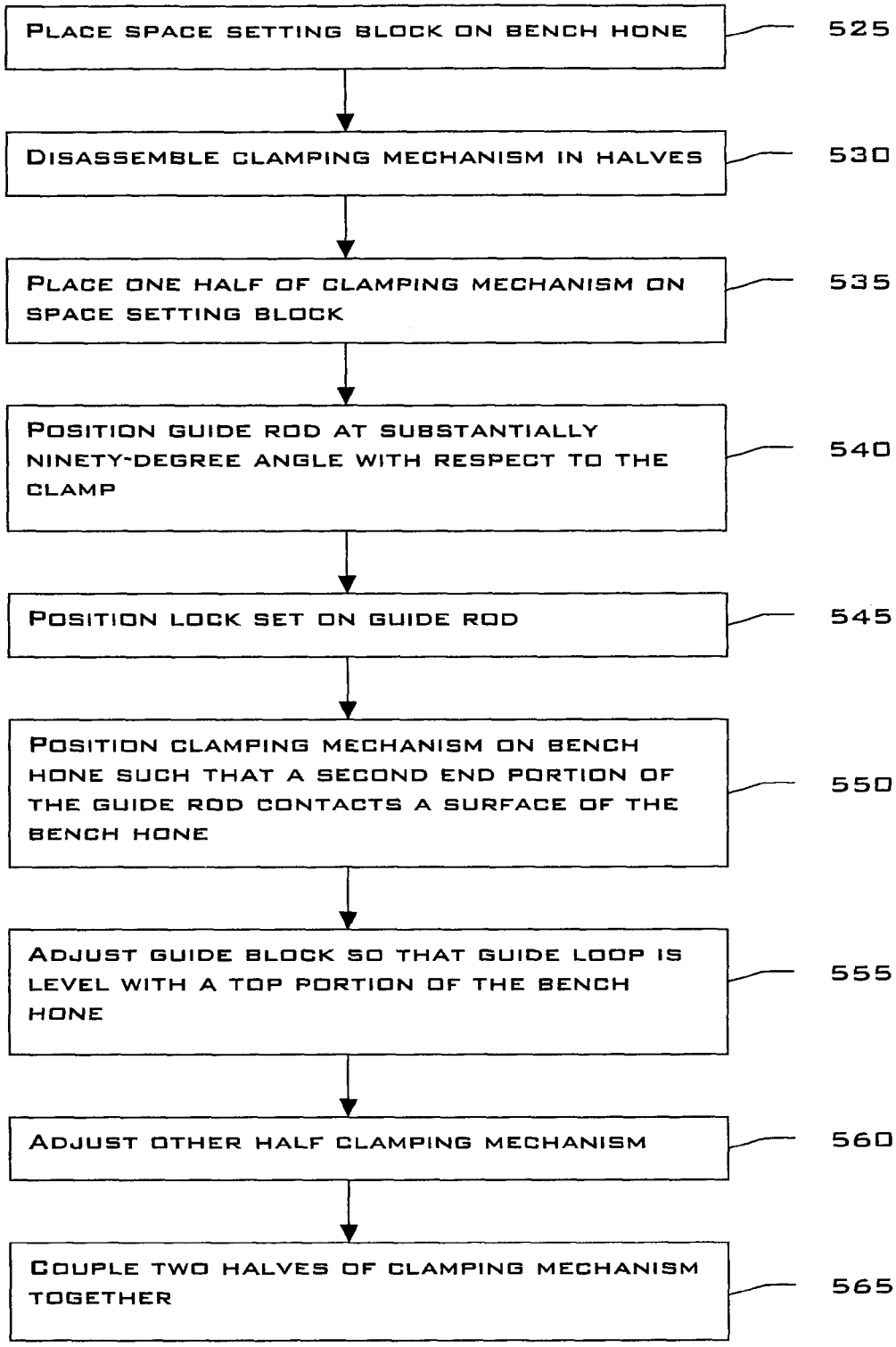
FIG. 16 illustrates a methodology for adjusting a knife sharpener apparatus in accordance with an aspect of the present invention.

In view of the foregoing structural and functional features described above, a methodology in accordance with various aspects of the present invention will be better appreciated with reference to FIG. 16. While, for purposes of simplicity of explanation, the methodology of FIGS. 16 is shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention.

FIG. 16 illustrates a methodology for adjusting a knife sharpener apparatus to a desired angle in accordance with an aspect of the present invention. At 525, a space setting block, as known in the art, is placed on a bench hone. A clamping mechanism is disassembled at 530 by removing any fasteners employed to couple the clamp mechanism together. One half of the clamping mechanism is placed on the space setting block at 535 such that a guide rod is hanging from the clamp in a vertically downward position. At 540, the guide rod is positioned so that the guide rod is at a substantially ninety-degree angle with respect to the clamp and a first end portion of the guide rod is contacting a surface upon which the bench hone is located. At 545, a lock set is placed on the guide rod at a point where the guide rod contacts the clamp mechanism such that the guide rod can be removed and repositioned on the clamp mechanism at a same height. At 550, the half of the clamping mechanism is positioned such that a second end portion of the guide rod contacts the surface upon which the bench hone is located. A guide block is then adjusted at 555 so that a guide loop is level with a top portion of the bench hone. At 560, the other half of the clamping mechanism is adjusted in a similar manner. Finally, at 565, the two halves are coupled together via one or more fasteners. The knife sharpener apparatus is now set to an angle designated by the space setting block.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A knife sharpener apparatus comprising:

a clamping mechanism operable to secure a knife blade; and at least one infinitely adjustable guide rod coupled to the clamping mechanism to adjust a sharpening angle of the knife sharpener apparatus, said guide rod being coupled to said clamping mechanism by a structure including an element which bears nonuniformly against a side of said guide rod, said clamping mechanism comprising a first clamp member and a second clamp member, said first clamp member having a longitudinal axis and surfaces substantially parallel to said longitudinal axis, at least one of said surfaces comprising a plurality of attachment positions.

2. The knife sharpener apparatus of claim 1, wherein said clamping mechanism defines a plane and is operable to secure a knife blade aligned substantially with said plane, said guide rod extending at least to said plane defined by said clamping mechanism.

3. A knife sharpener apparatus comprising a clamping mechanism operable to secure a knife blade and at least one infinitely adjustable guide rod coupled to the clamping mechanism to adjust a sharpening angle of the knife sharpener apparatus, wherein the at least one infinitely adjustable guide rod is not threaded, said clamping mechanism comprising a first clamp member and a second clamp member, said first clamp member having a longitudinal axis and surfaces substantially parallel to said longitudinal axis, at least one of said surfaces comprising a plurality of attachment positions.

4. A knife sharpener apparatus comprising a clamping mechanism operable to secure a knife blade proximate a distal end of said clamping mechanism and at least one infinitely adjustable guide rod coupled to the clamping mechanism to adjust a sharpening angle of the knife sharpener apparatus, wherein the clamping mechanism includes a first aperture and a second aperture, each said aperture operable to couple to the at least one infinitely adjustable guide rod, the distance from said first aperture to said distal end being greater than the distance from said second aperture to said distal end, wherein moving the at least one infinitely adjustable guide rod from said first aperture to said second aperture changes a sharpening angle of the knife sharpener apparatus.

5. The knife sharpener apparatus of claim 4, wherein said first and second apertures are located on a top portion of a clamp member.

6. The knife sharpener apparatus of claim 4, wherein said first and second apertures are located on a side portion of a clamp member.

7. A knife sharpener apparatus comprising a clamping mechanism operable to secure a knife blade and at least one infinitely adjustable guide rod coupled to the clamping mechanism to adjust a sharpening angle of the knife sharpener apparatus, further comprising at least one lock set to set a position of the guide rod, said clamping mechanism comprising a first clamp member and a second clamp member, said first clamp member having a longitudinal axis and surfaces substantially parallel to said longitudinal axis, at least one of said surfaces comprising a plurality of attachment positions.

8. The knife sharpener apparatus of claim 1, wherein the infinitely adjustable guide rod includes an integral guide loop.

9. A knife sharpener apparatus comprising a clamping mechanism operable to secure a knife blade and at least one infinitely adjustable guide rod coupled to the clamping mechanism to adjust a sharpening angle of the knife sharpener apparatus, further comprising an infinitely adjustable guide loop coupled to the infinitely adjustable guide rod.

10. The knife sharpener apparatus of claim 9, further comprising a guide block to secure the infinitely adjustable guide loop to the infinitely adjustable guide rod.

11. A knife sharpener apparatus comprising a clamping mechanism operable to secure a knife blade and at least one infinitely adjustable guide rod coupled to the clamping mechanism to adjust a sharpening angle of the knife sharpener apparatus, further comprising a swivel block to facilitate rotation of the infinitely adjustable guide rod towards the clamping mechanism.

12. A knife sharpener apparatus comprising:

a first clamp member;

a second clamp member coupled to the first clamp member, the first and second clamp members operable to secure a knife blade there between;

a first guide rod coupled to the first clamp member; and a first infinitely adjustable guide loop coupled to the first guide rod to adjust a sharpening angle of the knife sharpener apparatus.

13. The knife sharpener apparatus of claim 12, further comprising a second guide rod coupled to the second clamp member.

14. The knife sharpener apparatus of claim 13, further comprising a second infinitely adjustable guide loop coupled to the second guide rod.

15. The knife sharpener apparatus of claim 13, wherein a height of the first guide rod and a height of the second guide rod are adjustable.

16. The knife sharpener apparatus of claim 13, wherein a height of the first guide rod and a height of the second guide rod are infinitely adjustable.

17. The knife sharpener apparatus of claim 12, wherein a height of the first guide rod is infinitely adjustable.

18. The knife sharpener apparatus of claim 12, wherein at least one of the first clamp member and the second clamp member includes a plurality of apertures located therein to adjust a sharpening angle of the knife sharpener apparatus.

19. The knife sharpener apparatus of claim 12, wherein the first guide rod is foldable with respect to the first clamp member.

20. A knife sharpener apparatus comprising:

a clamping mechanism operable to secure a knife blade proximate a distal end of said clamping mechanism, said clamping mechanism having a first clamp member and a second clamp member, wherein at least one of the first and second clamp members includes a first aperture and a second aperture, the distance from said first aperture to said distal end being greater than the distance from said second aperture to said distal end, said knife sharpener apparatus further comprising a guide rod secured to one of said apertures, wherein moving said guide rod from said first aperture to said second aperture changes a sharpening angle of said apparatus.

21. The knife sharpener apparatus of claim 20, wherein said first and second apertures are located within a top portion of at least one of the first and second clamp members.

22. The knife sharpener apparatus of claim 20 wherein said first and second apertures are located within a side portion of at least one of the first and second clamp members.

23. The knife sharpener apparatus of claim 20, wherein the guide rod is coupled to one of said first and second apertures via a swivel block to facilitate foldability of the apparatus.

24. The knife sharpener apparatus of claim 20, wherein the guide rod is coupled to one of said first and second apertures via a slot in a block to facilitate infinite adjustment of the guide rod along a length of at least one of the first and second clamp members.

25. The knife sharpener apparatus of claim 20, wherein the guide rod has an infinitely adjustable height.

26. The knife sharpener apparatus of claim 20, wherein the guide rod includes an integral guide loop.

27. The knife sharpener apparatus of claim 20, wherein the guide rod includes an infinitely adjustable guide loop.

28. A knife sharpener apparatus comprising a clamping mechanism operable to secure a knife blade and at least one infinitely adjustable guide rod coupled to the clamping mechanism to adjust a sharpening angle of the knife sharpener apparatus, said apparatus being foldable wherein said guide rod is foldable towards said clamping mechanism.

29. The knife sharpener apparatus of claim 3, said clamp members being operable to secure a knife blade, said guide rod being held within a throat structure which does not directly contact said first or second clamp members.

30. A knife sharpener apparatus comprising a clamping mechanism operable to secure a knife blade and at least one infinitely adjustable guide rod coupled to the clamping mechanism to adjust a sharpening angle of the knife sharpener apparatus, further comprising at least one lock set to set a position of the guide rod, said clamping mechanism comprising a first clamp member and a second clamp member, said clamp members operable to secure a knife blade, said first clamp member defining a plane substantially perpendicular to the longitudinal axis of said guide rod, said guide rod extending at least to said plane.

* * * * *